United States Patent [19]

Roberts

[11] Patent Number: 4,967,978

[45] Date of Patent: Nov. 6, 1990

[54] WIRE STORAGE REEL

[75] Inventor: Christopher H. Roberts, Winford, England

[73] Assignee: EEL Limited, Somerset, England

[21] Appl. No.: 396,699

[22] Filed: Aug. 22, 1989

[30] Foreign Application Priority Data

Sep. 1, 1988 [GB] United Kingdom ..... 8820641

[51] Int. Cl.[5] ..... B65H 75/02; B65H 54/02

[52] U.S. Cl. ..... 242/129; 242/1; 242/25 R; 242/47; 242/159; 242/170

[58] Field of Search ..... 242/129, 25 R, 18 R, 242/47, 52, 53, 127, 118, 118.2, 118.4, 118.7, 118.8, 159, 170, 171, 1; 29/33 F, 861

[56] References Cited

U.S. PATENT DOCUMENTS 4,638,558 1/1987 Eaton ..... 242/129 X
4,685,636 8/1987 Eaton ..... 242/129
4,715,549 12/1987 Travlos ..... 242/129 X
4,715,557 12/1987 Rushing et al. ..... 242/129
4,718,633 1/1988 Weixel ..... 242/129

*Primary Examiner*—Stanley N. Gilreath
*Attorney, Agent, or Firm*—Larson & Taylor

[57] ABSTRACT

A wire storage reel includes a pair of resilient walls forming inner and outer annular wire storage cavities together with closure means which selectively operates to separate the cavities. The closure means comprise applying external pressure to the wall portions of the outer end of the inner cavity to close the inner cavity. In use, the wire is clamped to a winding mechanism and is initially wound on the reel with the inner cavity closed. The inner cavity is opened when the desired length of wire is wound on the reel. The winding mechanism is then released from the reel and the inner cavity is opened so that the winding mechanism may be rotated to a position wherein the leading and trailing ends of the wire protrude from the reel in a predetermined relationship.

8 Claims, 2 Drawing Sheets

Fig.1.
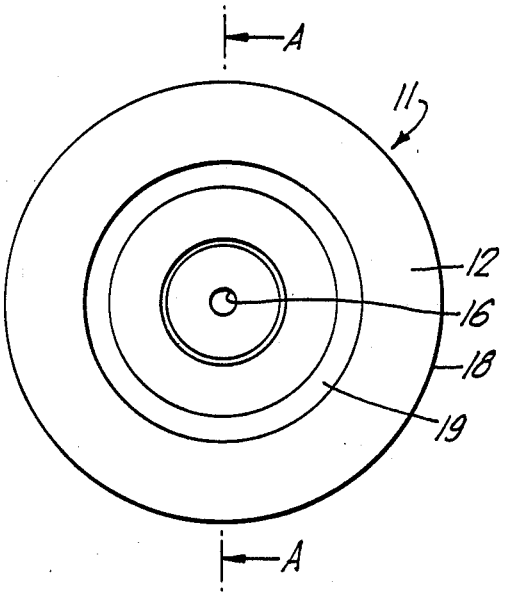
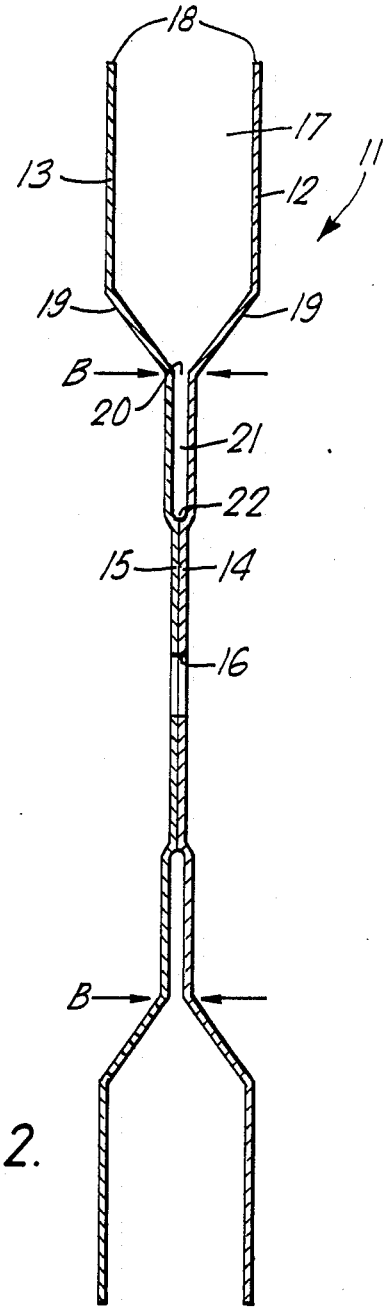
Fig.2.

WIRE STORAGE REEL

FIELD OF THE INVENTION

This invention relates to wire storage reels and is also concerned with a method and apparatus for winding wire on to wire storage reels so that leading and trailing ends of the wire protrude from the reel in a predetermined relationship.

DESCRIPTION OF THE PRIOR ART

US-A- No. 4638558 discloses a wire storage reel having a single wire storage cavity with peripheral portions resiliently pressed against each other to close the cavity and to retain the leading and trailing ends of the wire protruding from the cavity. The specification also describes and claims a method and apparatus for winding wire on to the reel which includes a chuck for mounting the reel and a chuck clamp rotatable with the chuck and including means for clamping the leading end of the wire. The chuck clamp has a predetermined angular "unload" position relative an axis of rotation so as to ensure that leading and trailing ends of the wire protruding from the reel are substantially aligned and extend in opposite directions from the reel.

In this prior device, once the predetermined length of wire has been wound into the reel cavity and the trailing end clamped, it is necessary to reverse the direction of rotation of the chuck carrying the reel and chuck clamp in order to return the chuck clamp to its predetermined "unload" position in order to establish the predetermined angular relationship of the leading and trailing wire ends. Such a requirement to reverse the direction of rotation complicates the drive mechanism and the control system and may also cause more fundamental problems as referenced hereinafter.

US-A- No. 4685636 discloses an improvement to the reel of the earlier patent specification which incorporates an inner closed cavity to permit stacking of the reels without tilting which occurred with the prior reels due to distortion of the peripheral portion by the protruding wire ends.

This specification again envisages reversing the direction of rotation of the reel to ensure that a predetermined angular relationship of the leading and trailing ends is achieved, and the specification highlights design constraints that have to be observed to prevent undesirable wire bending and protrusion from the peripheral entry lips during reversal of the direction of rotation. Such constraints inevitably mean that a universal application of individual reels in such apparatus is prevented.

SUMMARY OF THE INVENTION

Accordingly, in one aspect this invention provides a wire storage reel having a central hub portion and a first annular wire storage cavity including inner wall portions defining a normally open outer end of a second annular wire storage cavity having a closed inner end, and closure means for selectively closing said outer end of said second annular cavity.

The closure means may comprise resilient walls of said second cavity whereby said outer end can be closed by application of external pressure on said resilient walls.

In another aspect a wire storage reel includes first and second resilient side members forming a reel hub, the side members co-operating with each other to form a first annular wire storage cavity circumscribing the hub, said first cavity having inner walls opening into a second annular wire storage cavity between said first cavity and said hub, whereby said resilient side members can be pressed inwardly adjacent the outer end of the second cavity to selectively close said outer end.

In yet another aspect the invention provides a method for winding wire on a wire storage reel so that leading and trailing ends of the wire protrude from the reel in a predetermined angular relationship, comprising the steps of closing an outer annular end of an inner wire storage cavity, clamping a leading end of the wire in a clamp mounted on a winding arm, rotating the reel and winding arm about an axis in a direction of rotation so as to wind wire into an outer wire storage cavity, stopping rotation when a predetermined length of wire has been wound into said outer cavity, clamping a trailing end of the wire, opening said outer annular end of said inner wire storage cavity, rotating the winding arm in the same direction of rotation until the winding arm reaches a predetermined unload position, and severing the trailing end of the wire.

Conveniently, closure of said outer annular end of said inner annular wire storage cavity is accomplished by external pressure applied so as to press opposed surfaces of the reel towards each other.

In yet a further aspect the invention provides apparatus for winding wire on to a wire storage reel so that leading and trailing ends of the wire protrude from the reel in a predetermined angular relationship, comprising a rotatable chuck and attachment means for attaching the reel to the chuck, closure means for selectively closing an outer annular end of an inner wire storage cavity on the reel to separate said inner cavity from an outer annular wire storage cavity, first clamp means for clamping a leading end of the wire to a winding arm, drive means for driving the chuck and winding arm about an axis in a direction of rotation, second clamp means for clamping the trailing end of the wire and severing means for severing the trailing end of the wire, whereby with the closure means, closing the outer end of the inner cavity rotation of the chuck and winding arm winds a predetermined length of wire into said outer cavity and opening of the outer end permits movement of said wire into said inner cavity to permit further rotation of the winding arm in the same direction of rotation until a predetermined unload position is reached that ensures said predetermined angular relationship of the leading and trailing ends.

The closure means may comprise pressure means for selectively applying pressure to opposed surfaces of the reel so as to close said outer annular end of the inner wire storage cavity. Conveniently, the pressure means may comprise an outwardly extending ring member on the chuck and an external collar having an inwardly extending ring portion to co-operate with the ring member for selectively applying the pressure to said opposed annular surfaces.

BRIEF DESCRIPTION OF THE DRAWINGS

The invention will now be described by way of example only and with reference to the accompanying drawings in which, FIG. 1 is a side view of a reel constructed according to the invention, FIG. 2 is a sectioned view taken along lines A—A of FIG. 1, and FIGS. 3 to 8 inclusive are generally schematic illustrations depicting a method and apparatus for winding wire on to the reel of FIGS. 1 and 2.

DETAILED DESCRIPTION OF THE DRAWINGS

Figure 3:
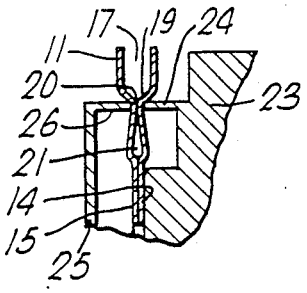

Referring to FIGS. 1 and 2 a wire storage reel 11 comprises two identically shaped preformed resilient sheets 12 and 13 of 1 mm thick plastics material having central hub sections 14 and 15 fixedly secured to one another about a common central aperture 16.

The sheets 12 and 13 are shaped to define a first outer annular wire storage cavity 17 having parallel outer walls terminating at peripheral edges 18. Converging inner wall portions 19 define a normally open annular outer end 20 of a second or inner annular wire storage cavity 21 having a closed inner end 22.

The width of the second cavity 21 is selected to be a clearance fit for the diameter of a single strand of wire which in operation is to be wound on to the reel, and is considerably less than a width of the first cavity 17 into which the bulk of wire is wound and stored as hereinafter described.

An important feature of the invention is the teaching of closure means for selectively closing the outer end 20 of the inner cavity 21 which in the illustrated embodiment is achieved due to the resilience of the individual sheets 12 and 13 which ensures that external pressure applied during operation and as hereinafter described in the direction of arrows B on FIG. 2, results in a recoverable deflection of the sheets to effectively close the outer end 20 of the second cavity 21.

A method and apparatus for winding wire on to the reel 11 will now be described with reference to FIGS. 3 to 8 inclusive.

The reel 11 is attached by any suitable means to a chuck 23 locating the hub portions 14 and 15 and having an outwardly extending ring member 24 for engagement with an outer surface of the reel 11 at a diameter corresponding with that of the outer end 20 of second chamber 21.

A collar 25 at the other side of reel 11 has a complementary inwardly extending ring portion 26 which co-operates with ring 24 when pressure is applied to effectively close the outer end 20 of chamber 21. It is important to note that the 'V' shape of the inner converging wall portions 19 of outer cavity 17 is retained whilst pressure is being applied.

A winding arm 26 (FIG. 4) for rotation with chuck 23 and about a coincident axis of rotation 27 carries adjacent an outer end a clamp 28 for securing the leading end 29 of a wire 30. The clamp 28 is located externally of the peripheral edges 18 of reel 11.

Figure 4:
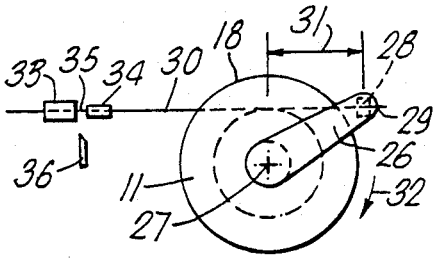

The winding arm 26 is shown in FIG. 4 in a "load" position in which the wire 30 extends across the reel 11 and is located at the bottom of the 'V' shape of the converging wall portions 19. Also, the location of the clamp 28 defines a predetermined length of wire that protrudes from the reel to terminate at leading end 29 as indicated at 31 in FIG. 4.

Rotation of the chuck 23, reel 11 and winding arm 26 in the direction of arrow 32 draws wire 30 through a measuring station 33 and wire guide 34 and winds it into the outer cavity 17. Rotation continues until a predetermined length of wire has been wound on to the reel 11 and a trailing end 35 is located correctly at a cut station comprising guillotine 36 (FIG. 5).

Figure 5:
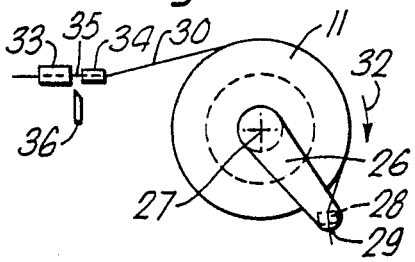
Figure 6:
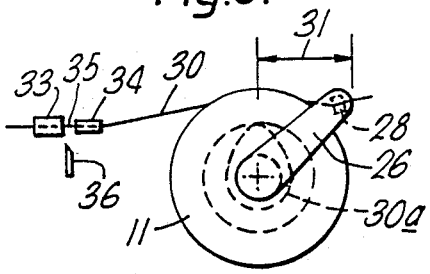

It is likely that the winding arm 26 will be angularly located at some arbitrary position within its rotation circle when it is stopped such as the position illustrated in FIG. 5 and, in order to satisfy the requirement that the leading and trailing ends 29 and 35 of the wire 30 are located generally parallel (aligned) to each other it is necessary to return the winding arm 26 to a predetermined "unload" position which in the illustrated embodiment corresponds to the "load" position of FIG. 4.

In the illustrated embodiment of the present invention this is accomplished by releasing the pressure applied by collar 25 which allows the resilience of the sheets 12 and 13 of reel 11 to recover their shape and open the outer end 20 of second cavity 21.

Winding arm 26 is then rotated in the same direction of rotation 32 as before about axis 27 until its "unload" position is reached when rotation is stopped. This further rotation of winding arm 26 is independent of the reel 11 and chuck 23 which remains stationary during this phase, and is permitted by the opening of outer end 20 of second cavity 21 which permits the first coil of wire 30 wound into the bottom of the 'V' shape of first cavity 17 to be wound into the second cavity 21 as indicated by the broken line 30*a* in FIG. 6. This also ensures that the desired length 31 of the leading end 29 of wire 30 is automatically maintained.

Figure 7:
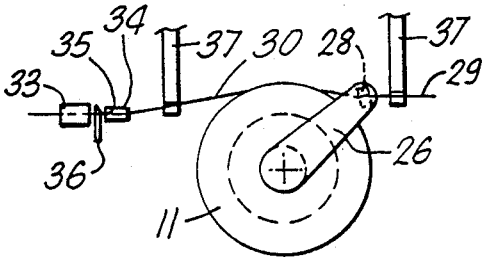

Once the winding arm 26 is returned to its "unload" position, the leading and trailing ends 29 and 33 of wire 30 are engaged by clamps 37 and the guillotine 36 is actuated to sever the trailing end 35 of the wire 30 as shown in FIG. 7. Clamp 28 on winding arm 26 is released.

The clamps 37 are used either to transport the loaded reel 11 through the next operation, for example the fitting of end terminals, or to place it in a transport box or container to await movement to the next operation.

Figure 8:
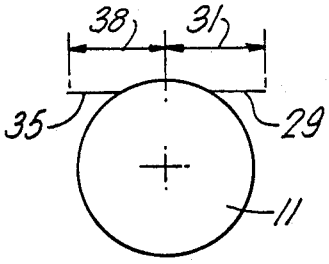

As illustrated in FIG. 8, irrespective of the length of wire 30 wound on reel 11, the leading and trailing ends 29 and 35 protruding from the reel 11 are substantially aligned and extend in opposite directions from the reel. Furthermore, the lengths 31 and 38 of the leading and trailing ends 29 and 35 respectively are either always the same as in the illustrated embodiment or in any other desired length relationship as may be required for a particular application.

Thus, in the present invention, the features of the reel 11 are such that in winding wire on to the reel the winding arm 26 is returned to its "unload" position by being rotated in the same direction of rotation as is used to initially wind the wire on to the reel 11. Apart from simplifying the control and drive systems this means that there is no danger of undesirable twisting or bending of the wire on the reel or of undesirable protrusion from the reel as can be experienced with the aforementioned prior art devices, and enhances the practicability of individual reels by ensuring the fullest utilisation.

As an example one particular reel is designed to accommodate any length of wire between 2 feet and 150 feet and of any diameter between 0.034 inches and 0.10 inches.

Whilst several embodiments of the invention have been described and illustrated it will be understood that many modifications may be made without departing from the scope of the invention as defined in the appended claims. For example, whilst in the described embodiment there is no requirement to incorporate retention means on the reel 11 in order to positively locate the leading and trailing ends 29 and 35, any suitable retention means could be incorporated if required to enable the reel 11 to be used with other methods of winding or other winding apparatus. The "load" and "unload" positions of winding arm 26 need not be coincident, for example, in an unillustrated embodiment the "load" position could be arranged so that wire clamp 28 is adjacent wire guide 34 to facilitate location of the leading end 29 of wire 30, whilst the "unload" position remains substantially as disclosed in the illustrated embodiment. The peripheral edges 18 of resilient sheets 12 and 13 of the illustrated embodiment could be flared outwardly to stiffen the wall portions of cavity 17 and assist wire winding.

What is claimed is:

1. A wire storage reel comprising a pair of resilient walls secured together and forming a central hub portion, an inner annular wire storage cavity disposed adjacent the central hub portion, said inner annular wire storage cavity having a closed inner end and a normally open outer end, an outer annular wire storage cavity disposed adjacent the outer end of the inner annular wire storage cavity and closure means for selectively closing the outer end of said inner annular wire storage cavity.

2. A wire storage reel according to claim 1 wherein said closure means includes means for applying external pressure on said resilient walls.

3. A wire storage reel including first and second resilient side members forming a reel hub, the side members co-operating with each other to form a first annular wire storage cavity circumscribing the hub, wherein said first cavity has inner walls opening into a second annular wire storage cavity between said first cavity and said hub, whereby said resilient side members can be pressed inwardly adjacent the outer end of the second cavity to selectively close said outer end.

4. A method for winding wire on a wire storage reel so that leading and trailing ends of the wire protrude from the reel in a predetermined angular relationship, comprising the steps of closing an outer annular end of an inner annular wire storage cavity, clamping a leading end of the wire in a clamp mounted on a winding arm, rotating the reel and winding arm about an axis in a direction of rotation so as to wind wire into an outer annular wire storage cavity, stopping rotation when a predetermined length of wire has been wound into said outer cavity, clamping a trailing end of the wire, opening said outer annular end of said inner wire storage cavity, rotating the winding arm in the same direction of rotation until the winding arm reaches a predetermined unload position, and severing the trailing end of the wire.

5. The method of claim 4, wherein the closing of said outer annular end of said inner annular wire storage cavity is accomplished by applying external pressure to opposed surfaces of said outer annular end of said inner annular wire storage cavity.

6. Apparatus for winding wire on to a wire storage reel so that leading and trailing ends of the wire protrude from the reel in a predetermined angular relationship, comprising a rotatable chuck and attachment means for attaching the reel to the chuck, closure means for selectively closing an outer annular end of an inner wire storage cavity on the reel to separate said inner cavity from an outer annular wire storage cavity, first clamp means for clamping a leading end of the wire to a winding arm, drive means for driving the chuck and winding arm about an axis in a direction of rotation, second clamp means for clamping the trailing end of the wire and severing means for severing the trailing end of the wire, whereby with the closure means closing the outer end of the inner cavity rotation of the chuck and winding arm winds a predetermined length of wire into said outer cavity and openIng of the outer end permits movement of the wire into said inner cavity to permit further rotation of the winding arm in the same direction of rotation until a predetermined unload position is reached that ensures said predetermined angular relationship of the leading and trailing ends.

7. Apparatus as claimed in claim 6, wherein said closure means comprises pressure means for selectively applying pressure to opposed surfaces of the reel so as to close said outer annular end of the inner wire storage cavity.

8. Apparatus as claimed in claim 7, wherein said pressure means comprises an outwardly extending ring member on the chuck and an external collar having an inwardly extending ring portion to co-operate with the ring member for selectively applying the pressure to said opposed annular surfaces.

* * * * *